US007523836B2

(12) United States Patent
Larsen

(10) Patent No.: US 7,523,836 B2
(45) Date of Patent: Apr. 28, 2009

(54) DUAL TROLLEY, SINGLE BOOM CRANE SYSTEM

(76) Inventor: Stuart Larsen, 1198 Navigator Dr., #78, Ventura, CA (US) 93001-4300

( * ) Notice: Subject to any disclaimer, the term of this patent is extended or adjusted under 35 U.S.C. 154(b) by 0 days.

(21) Appl. No.: 11/789,845

(22) Filed: Apr. 25, 2007

(65) Prior Publication Data

US 2008/0264889 A1 Oct. 30, 2008

(51) Int. Cl.
*B66C 17/00* (2006.01)

(52) U.S. Cl. ..... 212/316; 212/312; 212/325

(58) Field of Classification Search ..... 212/316, 212/312, 325
See application file for complete search history.

(56) References Cited

U.S. PATENT DOCUMENTS

| | | | | |
|---|---|---|---|---|
| 843,121 | A | | 2/1907 | Taylor |
| 844,423 | A | | 2/1907 | Taylor |
| 1,111,100 | A | | 9/1914 | Sawyer |
| 1,327,071 | A | | 1/1920 | Taylor |
| 1,436,861 | A | | 11/1922 | Collins |
| 1,443,382 | A | | 1/1923 | Rapier |
| 1,481,404 | A | | 1/1924 | Wright |
| 3,294,252 | A | * | 12/1966 | Hosoi et al. ..... 212/312 |
| 3,735,709 | A | | 5/1973 | Matsumoto et al. |
| 3,881,608 | A | | 5/1975 | Hupkes |
| 3,945,503 | A | | 3/1976 | Cooper |
| 4,750,429 | A | | 6/1988 | Mordaunt et al. |
| 5,515,982 | A | | 5/1996 | Hasegawa et al. |
| 5,570,986 | A | | 11/1996 | Hasegawa et al. |
| 5,775,866 | A | | 7/1998 | Tax et al. |
| 5,931,625 | A | | 8/1999 | Tax et al. |
| 6,530,492 | B2 | | 3/2003 | Weis |
| 6,976,599 | B1 | | 12/2005 | Rivera et al. |

* cited by examiner

*Primary Examiner*—Thomas J. Brahan

(57) ABSTRACT

A dual trolley, single boom crane system for loading and unloading containers from ships moored at a dock that effectively doubles the rate of container loading and unloading of conventional prior art single boom crane systems. The present invention also concerns a novel method for retrofitting conventional prior art single boom crane systems to convert them to dual trolley systems, while at the same time retaining the basic geometry of the prior art system so that the same number of multiple cranes may be positioned over the dock side.

3 Claims, 17 Drawing Sheets

DUAL TROLLEY, SINGLE BOOM CRANE SYSTEM

BACKGROUND OF THE INVENTION

1. Field of the Invention

The present invention relates generally to freight loading and unloading crane systems. More particularly, present invention concerns a novel dual trolley, single boom crane system that effectively doubles the rate of container loading and unloading of conventional prior art single boom crane systems. The present invention also concerns a novel method for retrofitting conventional prior art single boom crane systems to convert them to dual trolley systems.

2. Discussion of the Prior Art

A typical prior art single boom, single trolley container crane of the character currently found at many shipping container harbor terminals throughout the world is illustrated and FIGS. 1 and 1A of the drawings. These crane systems use a single trolley running on a single, continuous boom. A major problem with such systems is that the ability to use only a single trolley in such systems drastically restricts the capacity of the system. For this reason a number of attempts have been made in the past to modify the typical prior art single boom, single trolley crane systems in a manner to increase the rate at which containers can be handled by such systems. Exemplary of such an attempt is the container crane system illustrated and described in U.S. Pat. No. 6,976,599 issued to Rivera, et al. This patent discloses a crane apparatus that involves the use of a single crane through which repeated cycles of two simultaneously functioning trolleys may be moved along fixed paths on a boom. Pursuant to the Rivera, et al., invention, each of the trolleys is also moved along one of two parallel-spaced straight rail paths on a platform that is laterally displaced in a direction perpendicular to a fixed path on the boom for either straight-through transit of the trolley or lateral transfer thereof between fixed-boom rail paths so as to accommodate transfer of each trolley between the boom paths and either one of two loading and unloading positions under a central crane structure. One of the trolleys may thereby be cyclically emptied or loaded from one end of the boom, while the other trolley is either loaded with a container or emptied at one of the two positions underlying the platform. While the Rivera, et al., apparatus does indeed increase the loading/unloading rate, probably by a factor of 1.5, the increased width of the apparatus would, however, permit fewer cranes to be simultaneously positioned over the ship.

A further prior art attempt to improve the rate of container loading and unloading of prior art single boom, single trolley crane systems is disclosed in U.S. Pat. No. 6,981,598 also issued to Rivera, et al. Pursuant to this latest Rivera, et al., disclosure, a single crane is provided through which repeated cycles of two simultaneously functioning trolleys may be moved along a fixed-boom rail path and one of two 90 degree related rail paths on a turn-table platform pivotally mounted for rotation about an axis at the intersection of such platform rail paths so as to accommodate transfer of each trolley between the fixed-boom rail path and either one of the two platform rail paths positioned in alignment therewith by angular displacement of the turn-table platform. One of the trolleys may thereby be cyclically emptied or loaded from one end of the boom while the other trolley is either loaded with a container or emptied at one of the two positions underlying the platform. As was the case with the earlier Rivera, et al., invention, the increased width of the apparatus would permit fewer cranes to be simultaneously positioned over the ship.

Still another approach to improving the rate of loading and unloading of containers from dockside ships is disclosed in U.S. Pat. No. 3,945,503 issued to Cooper. The Cooper patent discloses a crane structure supporting a gantry having a pair of trolley rails mounted thereon. At least one trolley is mounted on the rails and a load engaging means is suspended from the trolley by reeving depending from sheaves mounted on the trolley. Means are provided for moving the sheaves apart a selected distance to angulate the reeving with respect to the loader engaging means, and means are provided for moving the trolley along the gantry rails to transport a load between its pickup and deposition areas. The dampening of sway in the load is accomplished by a "fleet-through" reeving arrangement and without the necessity of mounting the hoisting drums on movable trolleys. Moreover, the present invention coordinates the movements of the trolleys with reference to a single load point and prevents rocking movement of the load about a horizontal axis.

Yet another approach to improving the rate of loading and unloading of containers from dockside ships is disclosed in U.S. Pat. No. 3,881,608 issued to Hupkes. The Hupkes patent concerns a bridge crane for loading and unloading containers or packing crates into and from a vessel that comprises a support structure including a horizontal girder on which one or more carriages are supported for movement each provided with hoisting and propelling devices. A positioning member is also supported for movement along the girder independently of the carriage and is provided with sighting means for determining the position of the positioning member along the girder with respect to the vessel therebelow. A device which may be in the form of an arm for actuating a switch is mounted on the positioning member to halt the carriage at a predetermined distance from the positioning member. In the case where two carriages are provided, one is superimposed on the other and is capable of traveling in a vertical plane therewith and therepast with a load suspended therefrom.

As will become apparent from the discussion that follows, the present invention uniquely provides a novel dual trolley, single boom crane system that effectively doubles the rate of container loading and unloading of that conventional prior art single boom crane systems.

SUMMARY OF THE INVENTION

It is an object of the present invention to provide a novel dual trolley, single boom crane system that effectively doubles the rate of container loading and unloading of conventional prior art single boom crane systems.

Another object to the invention is to provide a method for retrofitting prior art single trolley, single boom systems into substantially more efficient dual trolley, single boom systems.

Another object of the invention is to provide a retrofit method of the character described in the preceding paragraph in which the modification of the prior art crane system is such that the width the crane remains unchanged.

Another object of the invention is to provide a retrofit method of the class described in which each individual prior art crane is effectively converted into two cranes having the same physical imprint so that when a multiple crane configuration is used, the same number of modified cranes can be placed over the ship to be unloaded thereby allowing a true doubling of the loading/unloading rate for the entire system.

Another object of the invention is to provide a retrofit method as described in the preceding paragraphs in which the retrofit operations can be accomplished on site with a minimum amount of downtime of the system.

DESCRIPTION OF THE INVENTION

Figure 1:
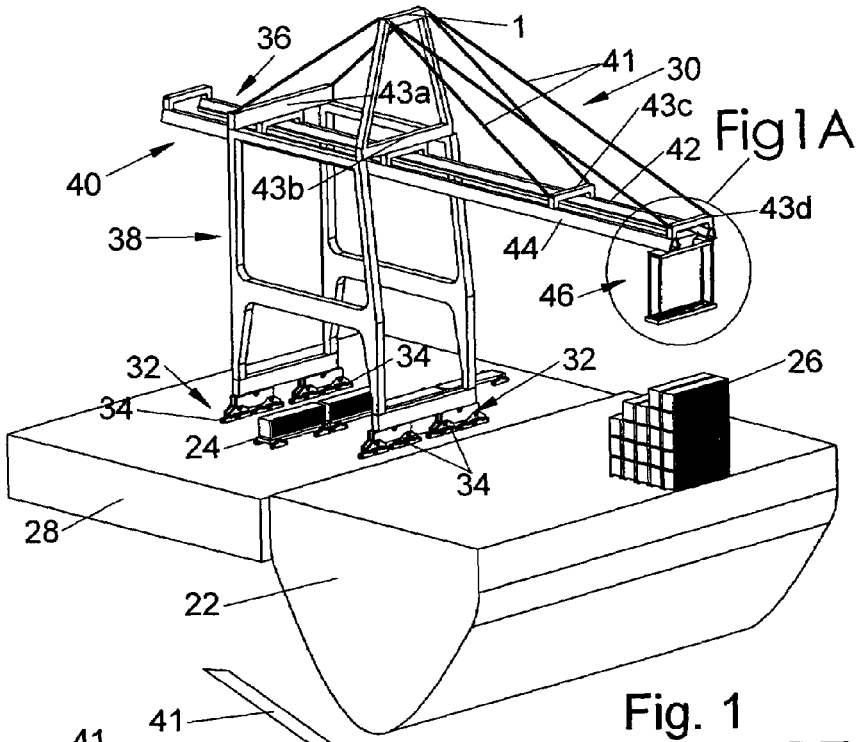
Fig. 1 PRIOR ART
FIG. 1 is a generally isometric view of a typical prior art single trolley, single boom crane system.
Figure 1A:
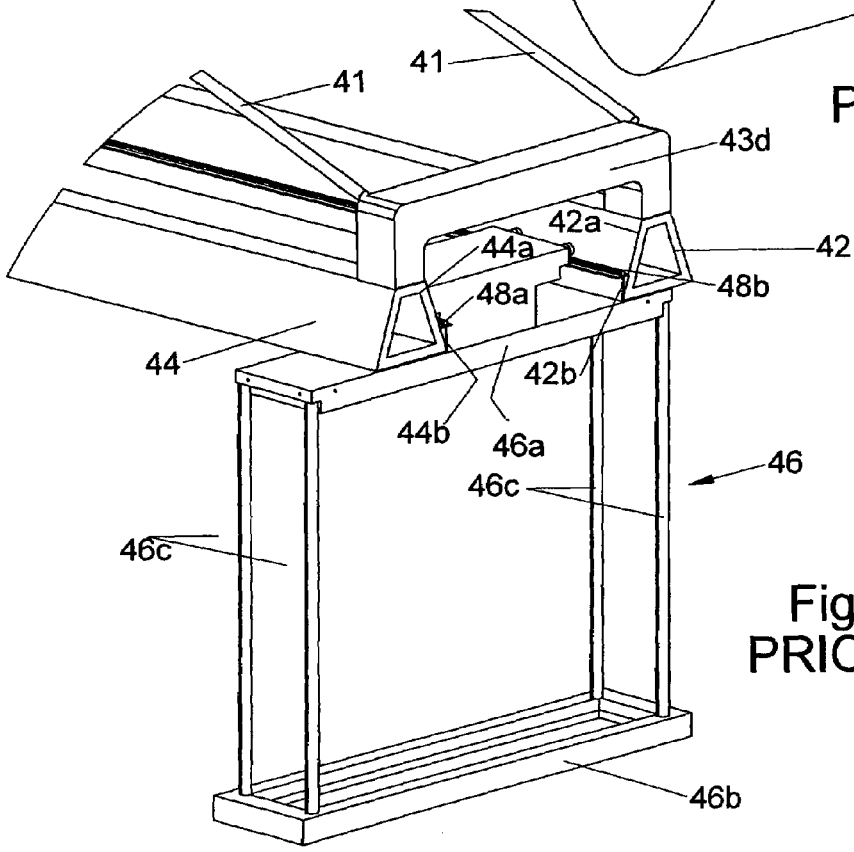
Fig. 1A PRIOR ART
FIG. 1A is a greatly enlarged, generally isometric fragmentary view of the area designated in FIG. 1 as "1A".

Referring to FIGS. 1 and 1A of the drawings, a typical prior art single trolley, single boom type crane system is there illustrated. This type of crane system can be found at numerous shipping container ports throughout the world to load and download shipping containers from barges and container ships 22 moored at dockside. The Panamax family of cranes is an example. These cranes have booms long enough to span and service ships too large to pass through the Panama Canal (Ships with beams greater than 13 containers wide.).

A dockside train flatcar system 24 is typically used to convey containers 26 to or from the dock 28. The crane 30 illustrated in FIG. 1 moves parallel to the edge of the dock on wheel assemblies 32 running on typical railroad rails 34. The single boom 36 of the crane 30 is supported by a crane frame, generally designated by the numeral 38, that positions the boom perpendicular to the edge of the dock. A supporting truss assembly 40 that includes cables 41 and transverse bridge frame members 43*a*, 43*b*, 43*c* and 43*d* suspends the boom over the dock in the manner illustrated in FIG. 1. The single boom 36 comprises an assembly made up of a left boom element 42 and a right boom element 44. The single trolley 46 of the prior art crane system, which runs along tracks 48*a* and 48*b*, comprises an upper spreader 46*a*, a lower spreader 46*b* and a cable system 46*c* that interconnects the vertically spaced spreaders.

Figure 2:
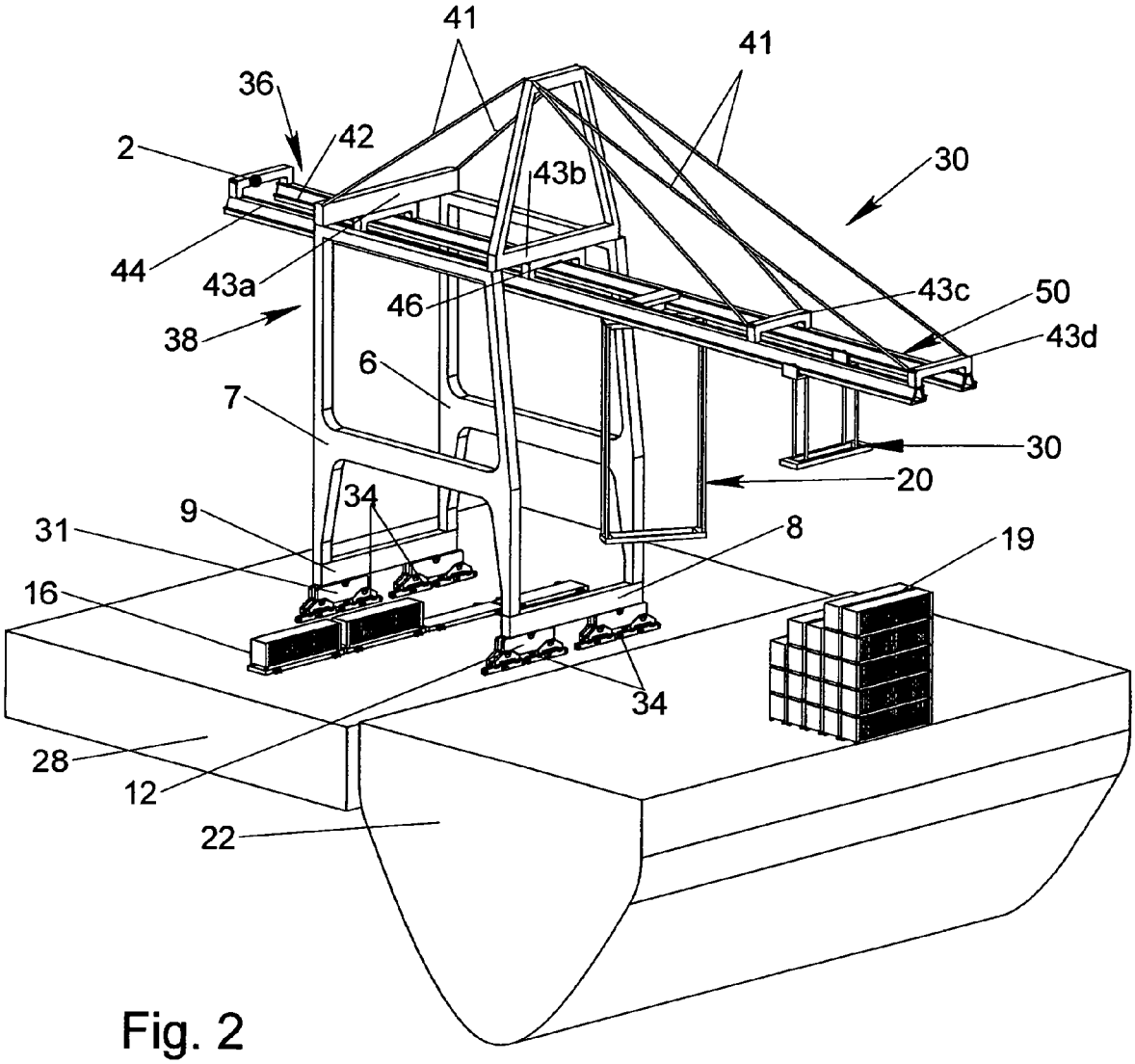
FIG. 2 is a generally isometric view of one form of the dual trolley, single boom crane system of the present invention.

Turning now to FIG. 2 of the drawings, the dual trolley, single boom crane system of the present invention is similar in many respects to that shown in FIGS. 1 and 1A and like numerals are used in FIG. 2 to identify like components. However, in the crane system of the present invention, the single boom, which is identified in FIG. 2 by the 50, has been modified to support a dual trolley system the character of which will presently be described.

Figure 3:
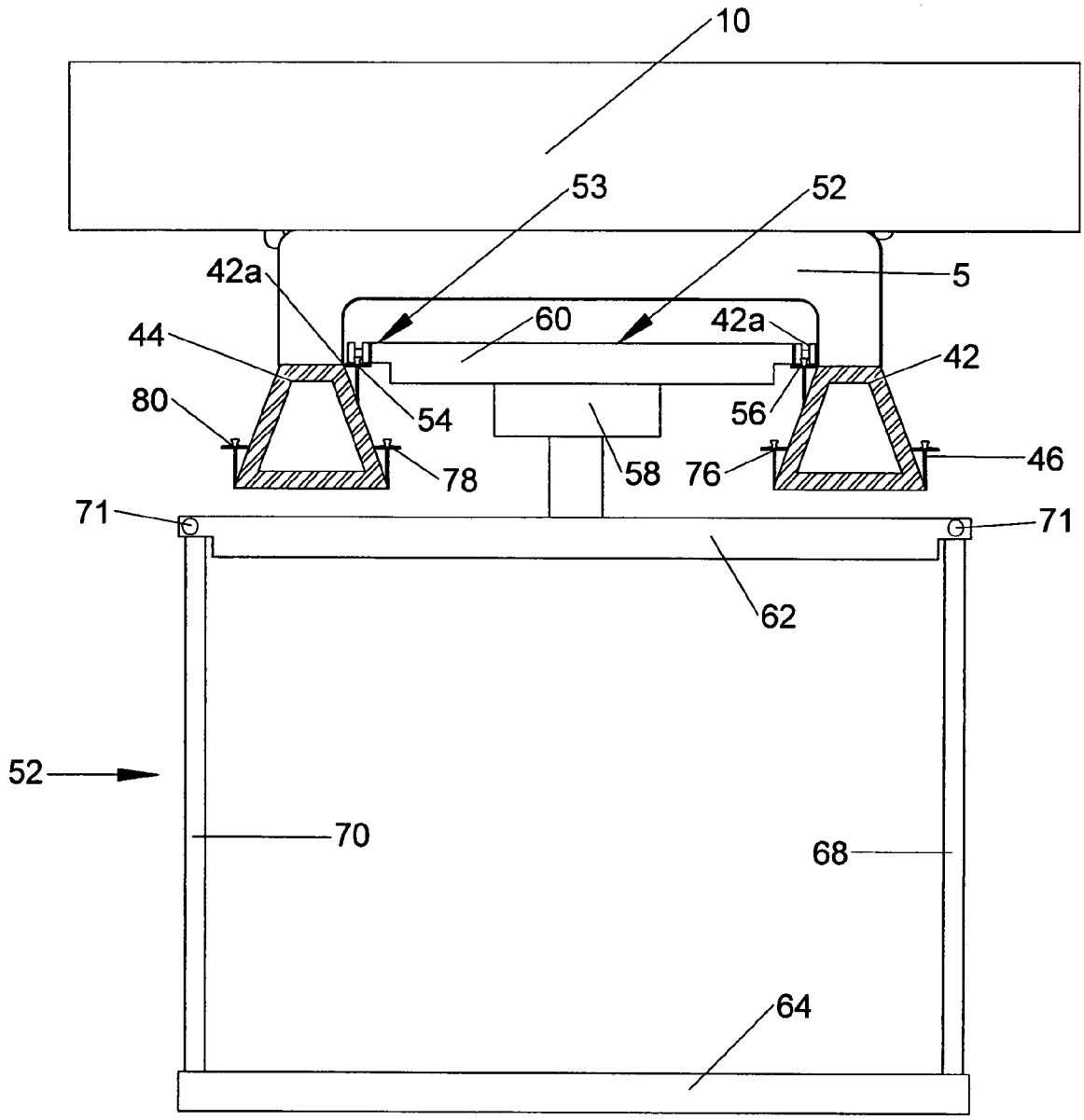
FIG. 3 is an enlarged front view of a portion of the dual trolley, single boom crane system illustrated in FIG. 2 showing the construction of the upper trolley assembly of the system.
Figure 7:
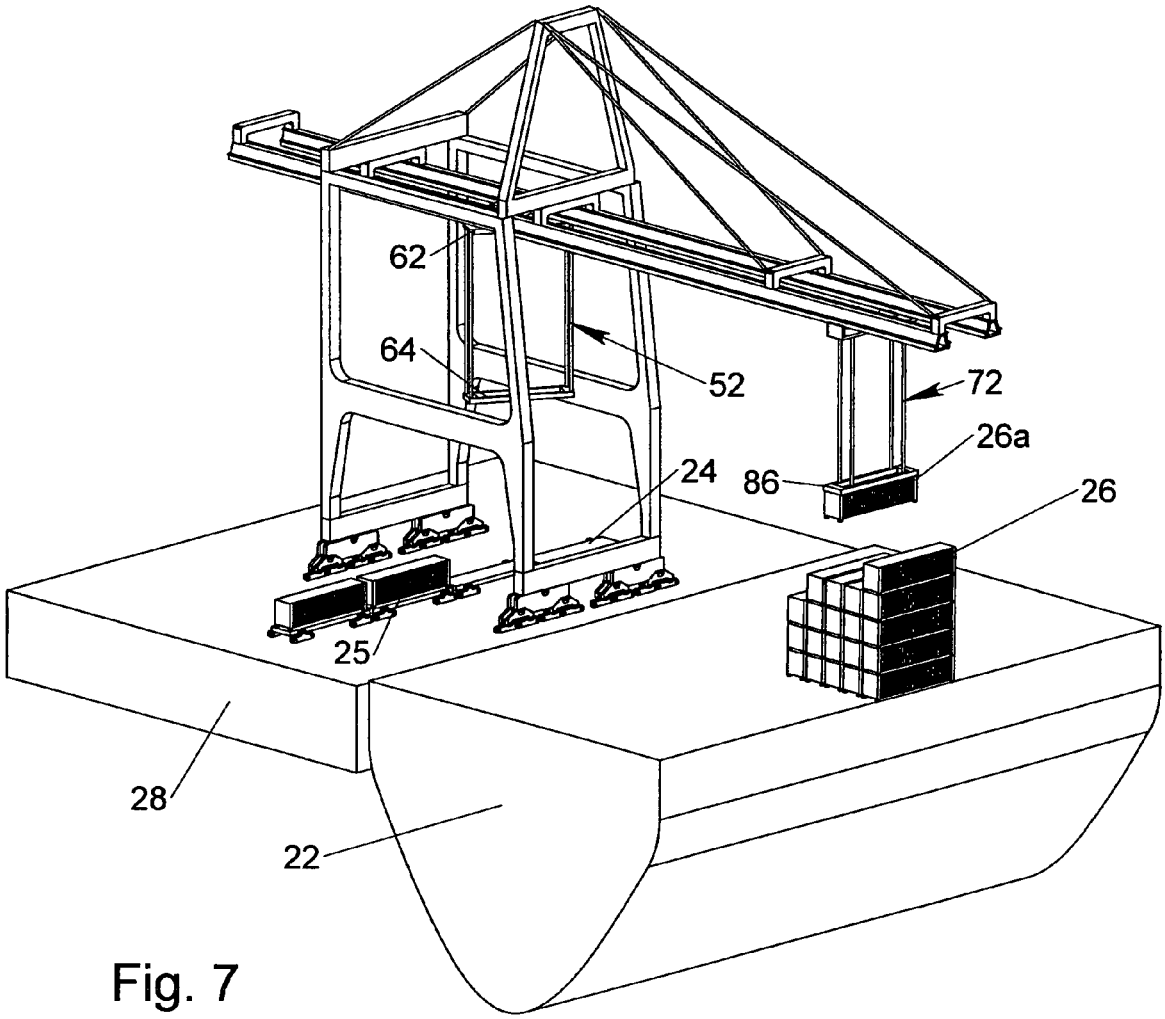
FIG. 7 is a generally isometric view, similar to FIG. 6, but showing the loaded lower trolley starting its movement toward the dock and showing the empty upper trolley starting its movement toward the barge.

Referring to FIGS. 2 and 3 of the drawings, the upper, or first of the dual trolley assemblies 52 is similar to the trolley of the prior art single boom, single trolley system, but has been elevated to roll along a first track system 53 that comprises first and second tracks 54 and 56 that are mounted on the top inside edges of the left and right boom elements 44 and 42. In a manner presently to be described, first trolley system 52 is movable along first track assembly 53 between a first position over the dock 28 and a second position over the vessel 22. As best seen in FIG. 3, first trolley system 52 comprises a first upper spreader 62, a first lower spreader 64 for interconnection with a shipping container, a first pair of spaced-apart cables 68 and 70 interconnecting the spreader and a conventional cable drive system 71 for raising and lowering the lower first spreader 64. Additionally, the first, or upper trolley assembly 52, includes a turntable 58 that is interconnected with a transversely extending bridge member 60 that also forms a part of the upper trolley assembly 52. As indicated in FIGS. 3 and 7, turntable 58, which is also connected to an upper first spreader 62, functions to rotate the first upper spreader and the first lower spreader through an angle of between about 0 and about 90 degrees relative to their starting position wherein the spreaders are generally parallel to the waterside edge of the dock.

As will be discussed in greater detail hereinafter, an important aspect of the retrofit of an existing single trolley system is to avoid any dependency on, or structural attachment of the top trolley assembly to, the bottom inside and outside edges of the right and left boom elements 42 and 44.

Figure 4:
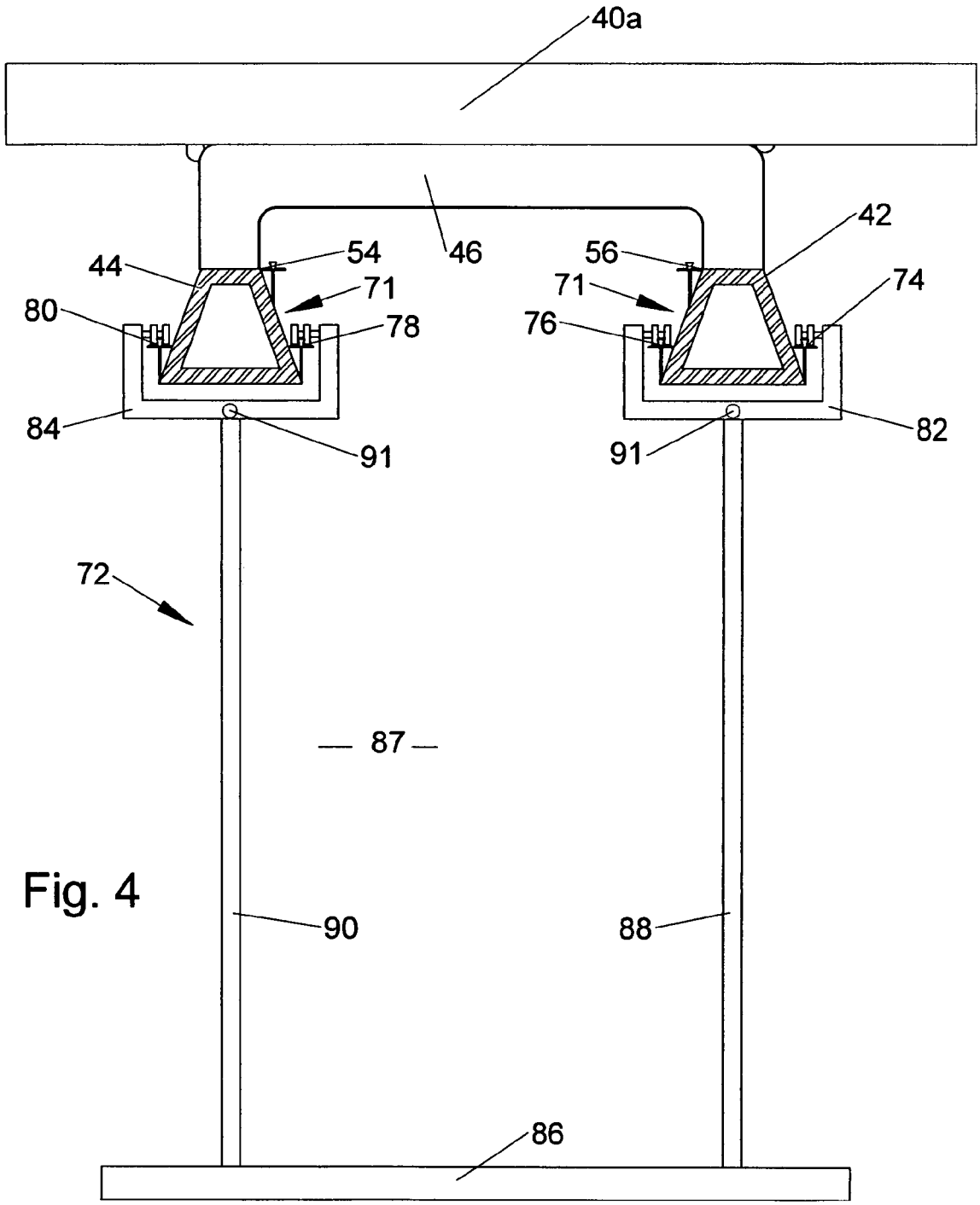
FIG. 4 is an enlarged front view of a portion of the dual trolley, single boom crane system illustrated in FIG. 2 showing the construction of the lower trolley assembly of the system.

Referring also to FIG. 4 of the drawings, the modified crane system of the invention can be seen to include a second track system 71 that is carried by elongated boom 36 and a second trolley system 72 carried by second track system 71 and is movable therealong between a first position over the dock 28 and a second position over the vessel 22. Second track system 71 here comprises spaced-apart rails 74 and 76 that are mounted on the inside and outside bottom edge of boom element 42 and spaced-apart rails 78 and 80 that are mounted on the inside and outside bottom edge of boom element 44. The second trolley system here comprises spaced-apart first and second carriages 82 and 84, a second lower spreader 86 for interconnection with a shipping container 26 and a second pair of spaced-apart cables 88 and 90 interconnecting the first and second carriages with second lower spreader 86. A conventional cable drive system 91 is provided for raising and lowering the lower second spreader 86.

As can be seen from a study of FIG. 4 of the drawings, the region between carriages 82 and 84 and above trolley spreader 86 is unobstructed space. This region, which is referred to hereinafter as the intersection or bypass zone 87, permits the top trolley assembly 52, when rotated into the 90 degree position, shown in FIG. 5, to pass without interference below the trolley carriages 82 and 84 and above the bottom trolley spreader 86. With this novel construction, the top trolley assembly 52 and the bottom trolley assembly 86 can operate independently of one another with the only restriction being that the top trolley upper spreaders 62 and 64 must be in the 90 degree position and the top trolley lower spreader 64 must be positioned above the bottom trolley spreader 86 as both trolleys approach the bypass zone. The bypass zone need not remain at the same longitudinal location along the boom and may shift inboard or outboard along the boom, as the loading/unloading schedule requires. Additionally, the bypass zone need not remain at the same vertical location and may shift higher or lower as the loading/unloading schedule requires. The control system, however, must assure that the trolleys have the proper geometry as they approach the bypass zone. In normal operation, the trolleys will approach the bypass zone while moving in opposite directions with one trolley transporting a container and the other trolley being empty. In order to maximize the loading/unloading rate, the bypass zone should preferably be located proximate the midpoint distance along the boom between the pickup and deposit locations of the containers. As previously mentioned, with creative engineering design, and in accordance with one form of the method of the invention, a portion of these modifications can be accomplished while the cranes remain in service and other required modifications can be accomplished with a minimum of down-time. For ports that have no additional dock space for new cranes, the only way of realizing an increase in the loading/unloading rate of the crane system may be through the accomplishment of crane modifications in accordance with the retrofit methods of the present invention.

Figure 6:
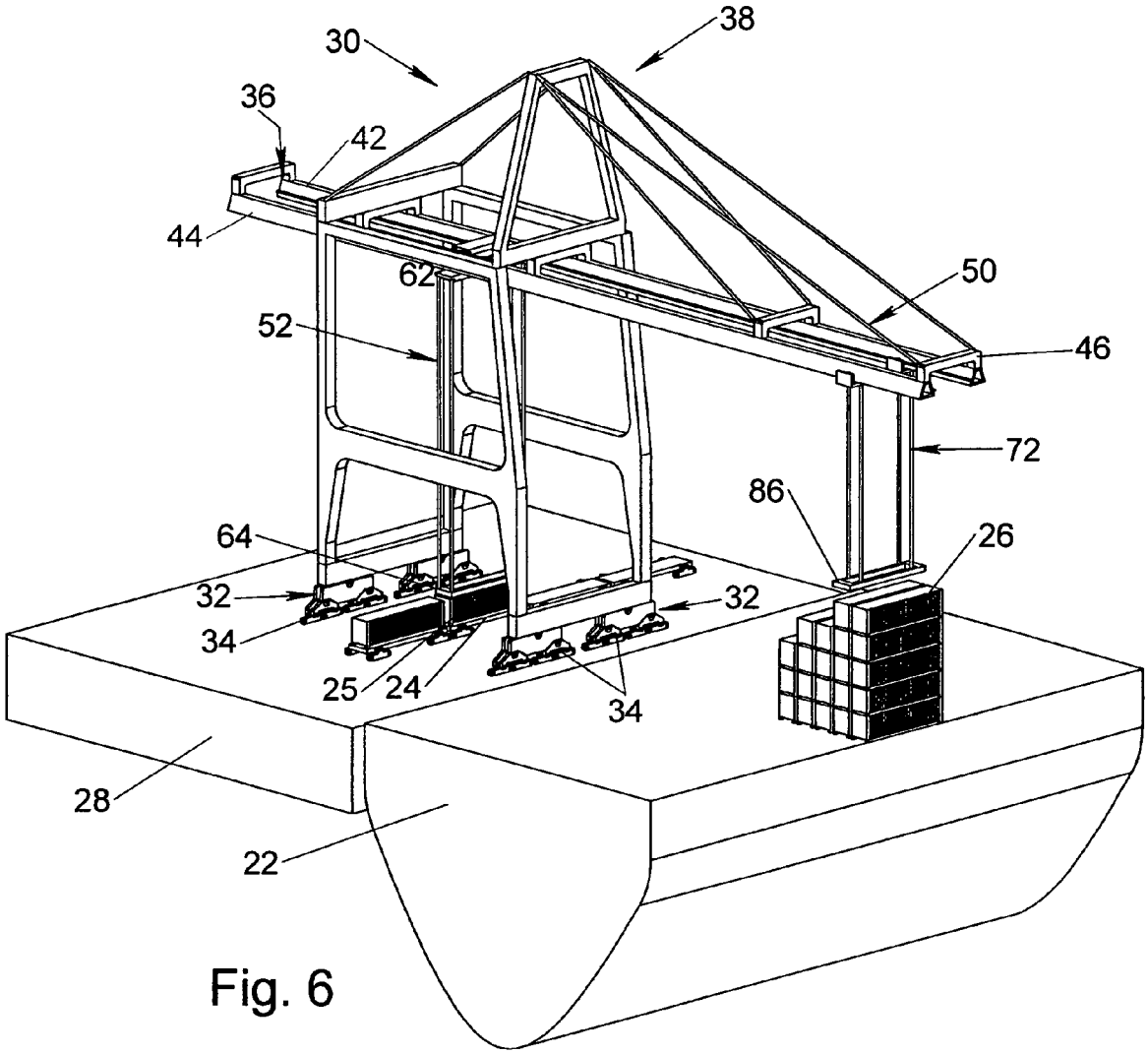
FIG. 6 is a generally isometric view, similar to FIG. 2, showing the lower trolley in a container load position and showing the upper trolley in a container deposit position.

Considering now the details of the operation of the novel duel trolley, single boom crane system of the present invention, FIG. 6 of the drawings illustrates the upper, or first, trolley system 52 in a position over the dock 28 with the lower spreader 64 thereof positioned over a container flat car 24 so that a shipping container 25 can be deposited on the flat car. In this position, the trolley turntable 58 has rotated the upper and lower spreaders 62 and 64 to a position wherein they are in the 0° position, that is, a position wherein they are substantially parallel to the water edge of the dock 28. When the upper trolley system 52 is in the container deposit position over the dock, the lower trolley system 72 is positioned over the shipboard container stack 26 with the bottom trolley spreader 86 thereof in position to pick-up a container from the container stack 26.

Turning next to FIG. 7 of the drawings, it can be seen that the first, or upper trolley system 52 has released shipping container 25 and the lower spreader 64 thereof has been elevated by the cable drive system 71 in a manner well understood by those skilled in the art. Trolley assembly 52 has also been moved along spaced-apart rails 54 and 56 of FIG. 3 in a direction toward the ship 22. In this position the trolley turntable 58 has also rotated spreaders 62 and 64 to a position of about 30 degrees. At this same approximate time the trolley assembly 72 has, through operation of the cable drive system 91, picked up a shipping container **26*a* from the shipping container stack 26. Additionally, as shown in FIG. 7, after picking up the shipping container 26*a*, the trolley assembly has also been moved along rollers 74, 76, 78 and 80 of FIG. 4 in a direction toward the dock area 28**.

Figure 8:
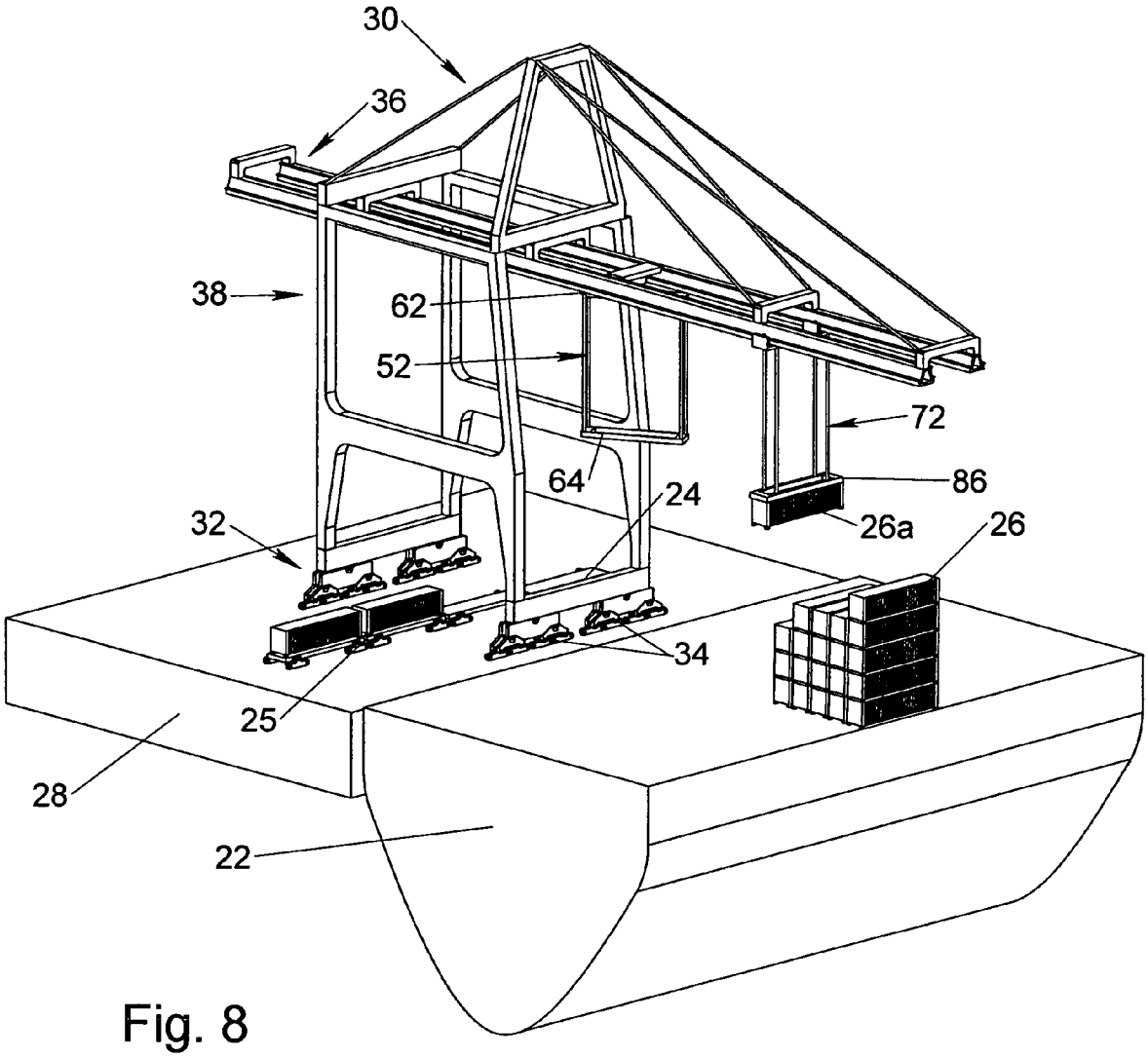
FIG. 8 is a generally isometric view, similar to FIG. 7, showing the loaded lower trolley continuing its movement toward the dock and also showing the empty upper trolley continuing its movement toward the barge, but rotated approximately 60 degrees from its starting orientation.

As illustrated in FIG. 8 of the drawings, as the empty upper trolley assembly 52 has continued to move towards the ship, the upper and lower spreaders 62 and 64 have been raised and further rotated from the approximate 30 degree position to an approximate 60 degree position. At this same approximate time, trolley assembly 72, which is now transporting shipping container **26*a***, has continued to move toward the dock.

Figure 9:
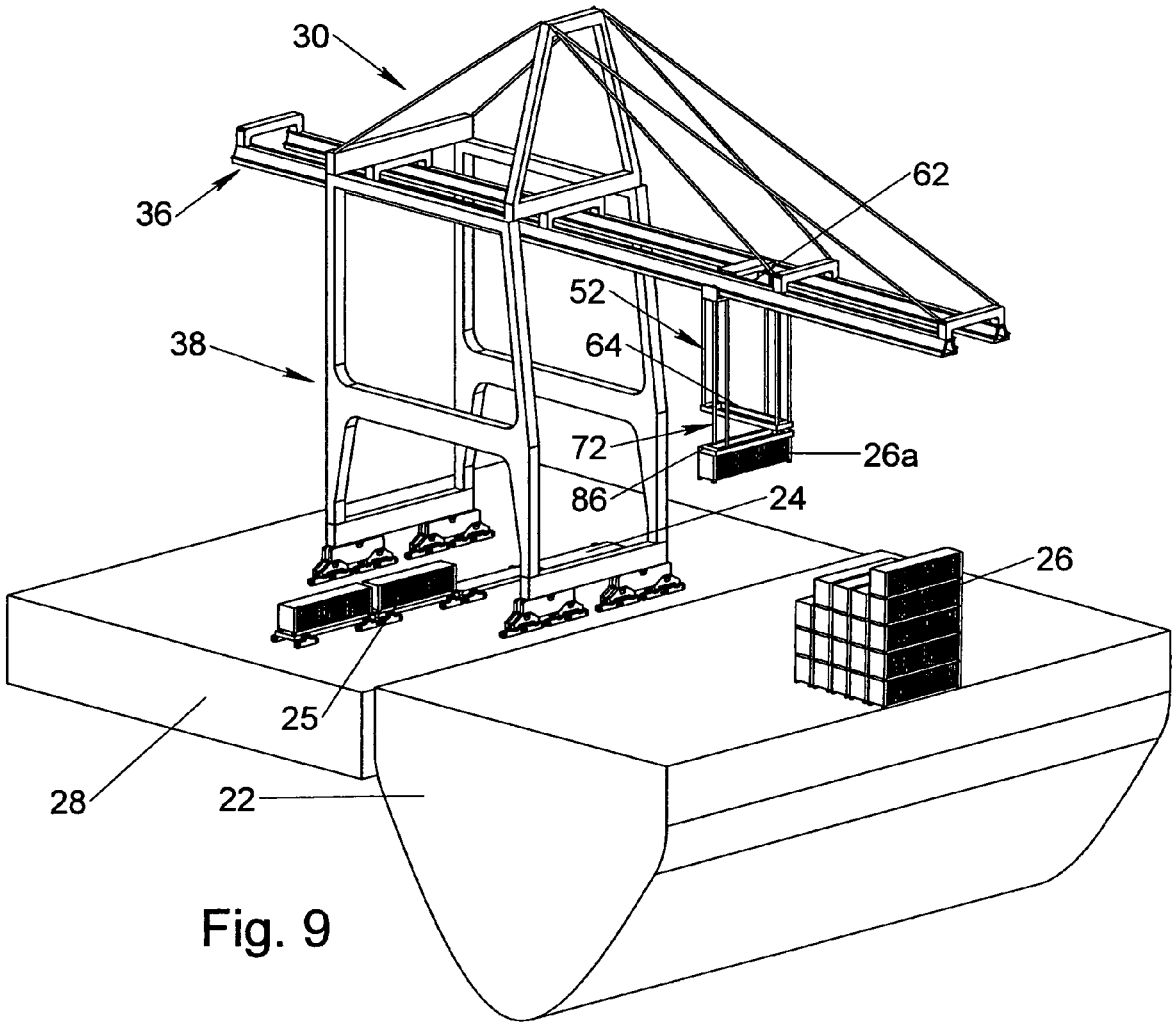
FIG. 9 is a generally isometric view, similar to FIG. 7, showing the loaded lower trolley and empty upper trolley having reached the bypass zone with the upper trolley having been rotated approximately 90 degrees from its starting orientation to permit the two trolleys to continue to move in opposite directions on the single boom of the system.

Turning now to FIG. 9 of the drawings it can be seen that the empty upper trolley assembly 52 has continued to move toward the ship 22 and toward the previously discussed bypass zone. Meanwhile, the lower spreader 64 of the trolley assembly 52 has been raised even further. As the trolley assembly 52 moves toward the bypass zone, the trolley turntable 58 has further rotated the upper and lower spreaders 62 and 64 from their 60 degree position to an approximate 90 degree position wherein lower spreader 64 resides above the lower spreader 86 of the trolley assembly 72 and between the cables 88 and 90 of the cable system of the trolley assembly 72.

Figure 10:
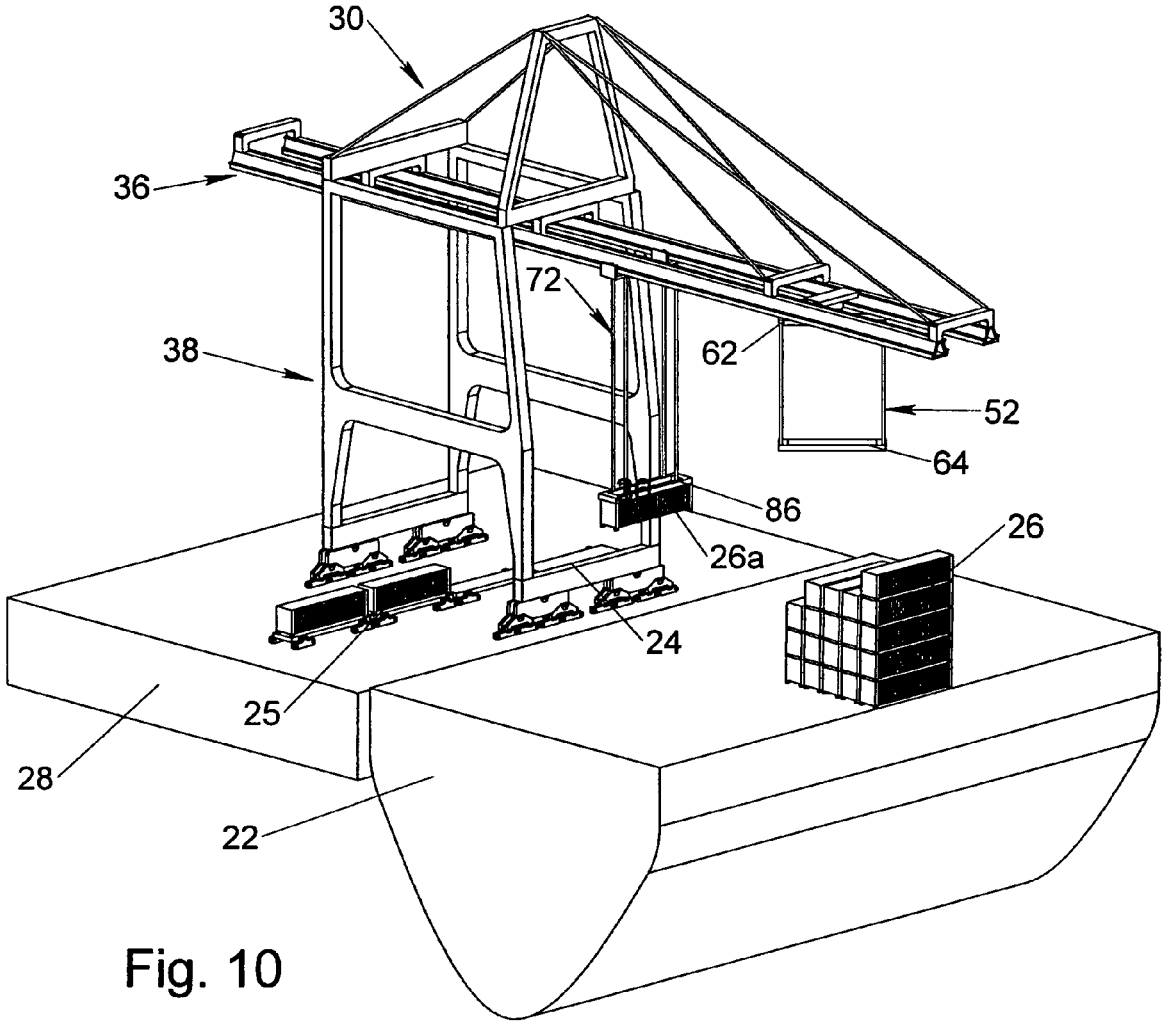
FIG. 10 is a generally isometric view, similar to FIG. 9, showing the loaded lower trolley continuing its movement toward the dock and also showing the empty upper trolley continuing its movement toward the barge, but once again rotated approximately 60 degrees from its starting orientation.

As best seen in FIG. 10 of the drawings, trolley assembly 52 has now exited the bypass zone and has continued to move toward the ship. As it moves toward the ship, the trolley turntable 58 has rotated the upper and lower spreaders 62 and 64 from the approximate 90 degree position to an approximate 60 degree position. At this same approximate time, as the loaded trolley assembly 72 moves toward the loading dock, the spreader 86 thereof is lowered in the manner illustrated in FIG. 10.

Figure 11:
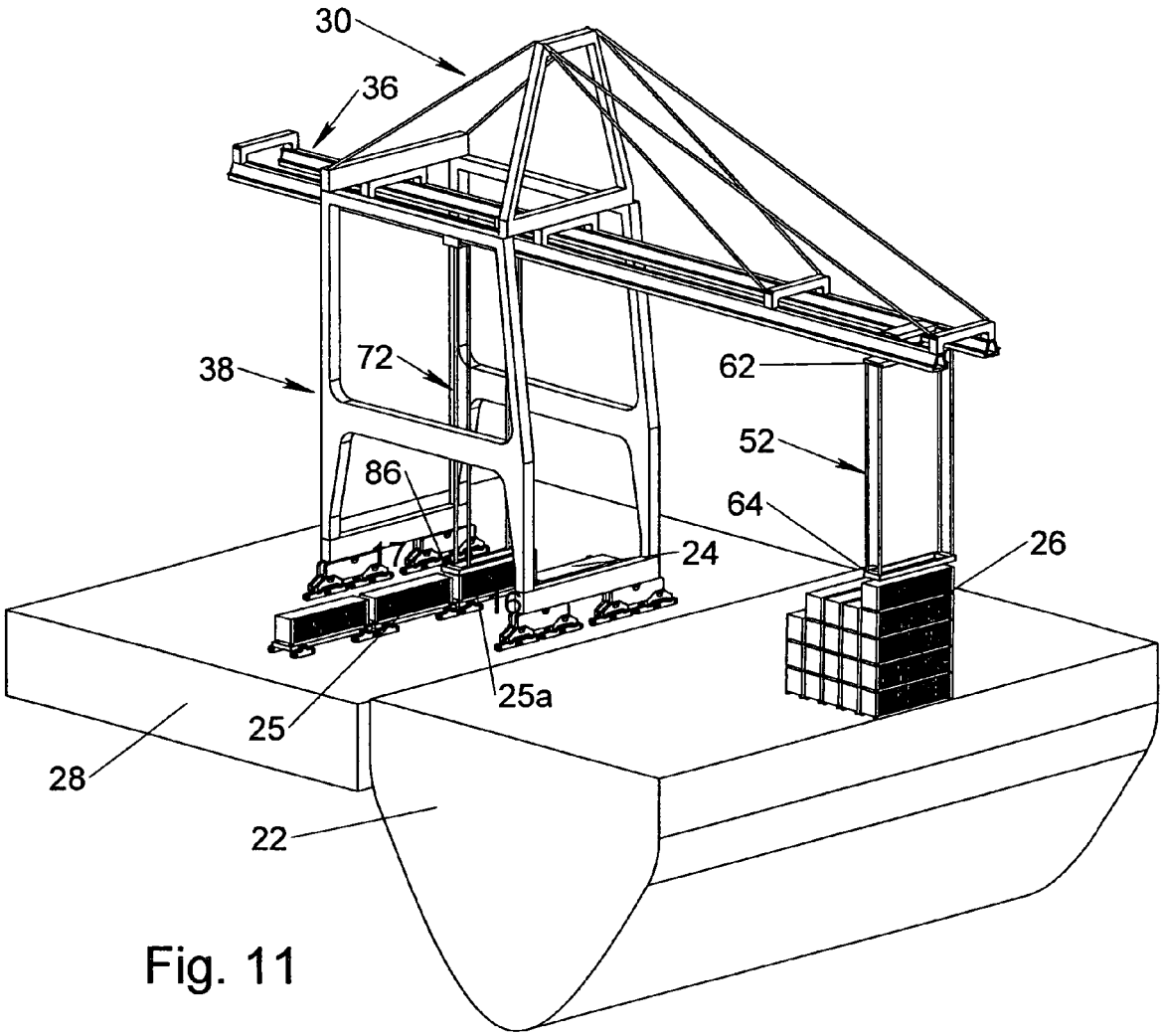
FIG. 11 is a generally isometric view, similar to FIG. 10, showing the loaded lower trolley in a container deposit position and showing the upper trolley in a container load position.

Referring next to FIG. 11, the trolley system 52 has now moved to a position where it is located over the shipboard container stack 26 with the bottom trolley spreader 64 thereof in position to pick up a container from the container stack. In this position, the trolley turntable 58 has rotated the spreaders 62 and 64 to the approximate 0 degree position, that is, the position wherein the spreaders are substantially parallel to the centerline of the ship, or barge 22. As indicated in FIG. 11, trolley system 72 has now moved into a position over the dock 28 with the lower spreader 86 thereof positioned over a container flat car 24 so that a shipping container 25*a* can be deposited on the flat car.

Figure 12:
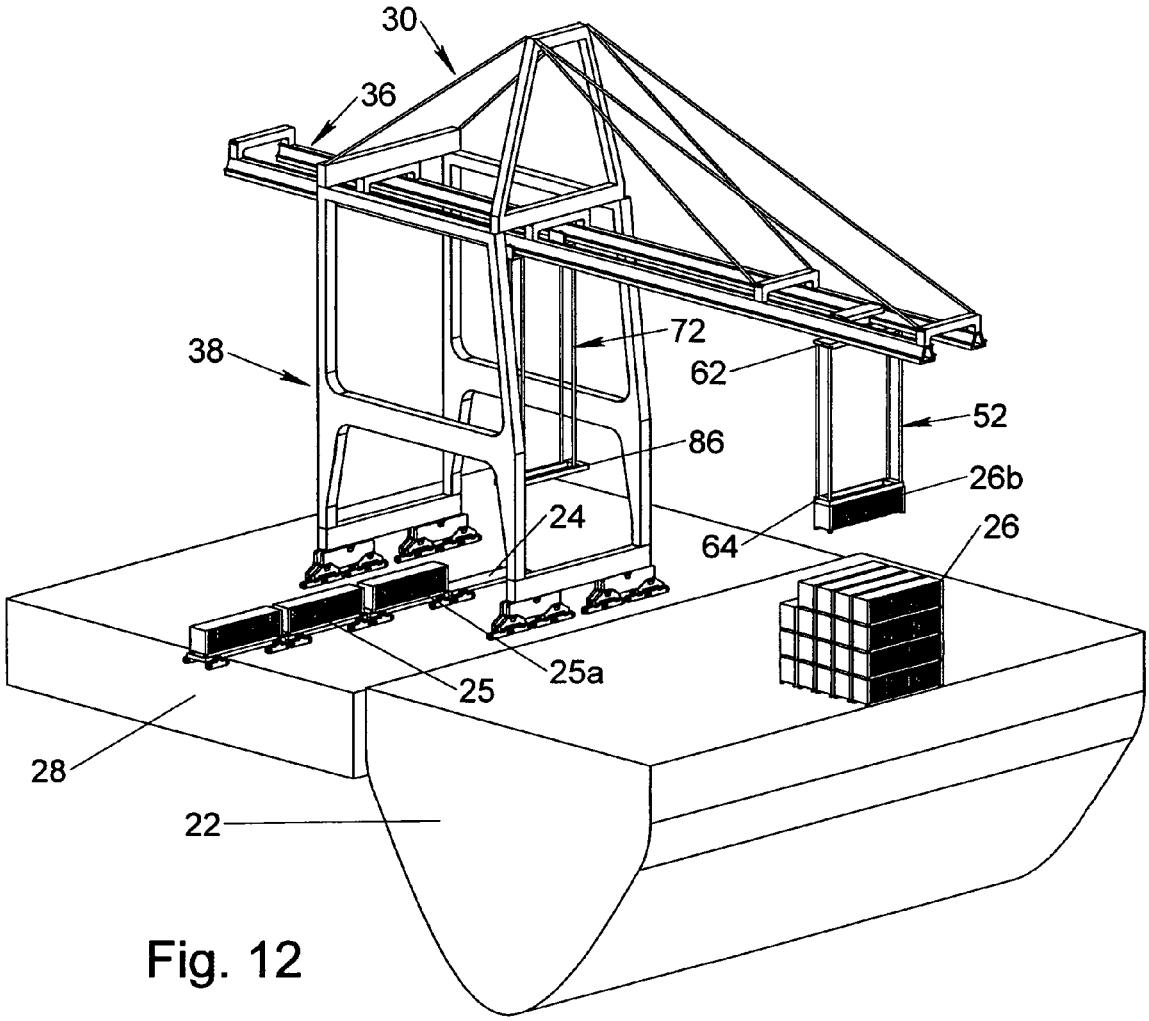
FIG. 12 is a generally isometric view, similar to FIG. 11, but showing the now loaded upper trolley starting its movement toward the dock and showing the empty lower trolley starting its movement toward the barge.

Turning to FIG. 12 of the drawings, it can be seen that the trolley assembly 72 has released shipping container 25*a* and the lower spreader 86 has been elevated by the cable drive system 91.

The trolley assembly 52 has now, through operation of the cable drive system 71, picked up a shipping container 26*b* from the shipping container stack 26 and has also been raised and moved in a direction toward the dock. At this same approximate time, trolley assembly 72 has moved toward the bypass zone and toward the ship 22.

Figure 13:
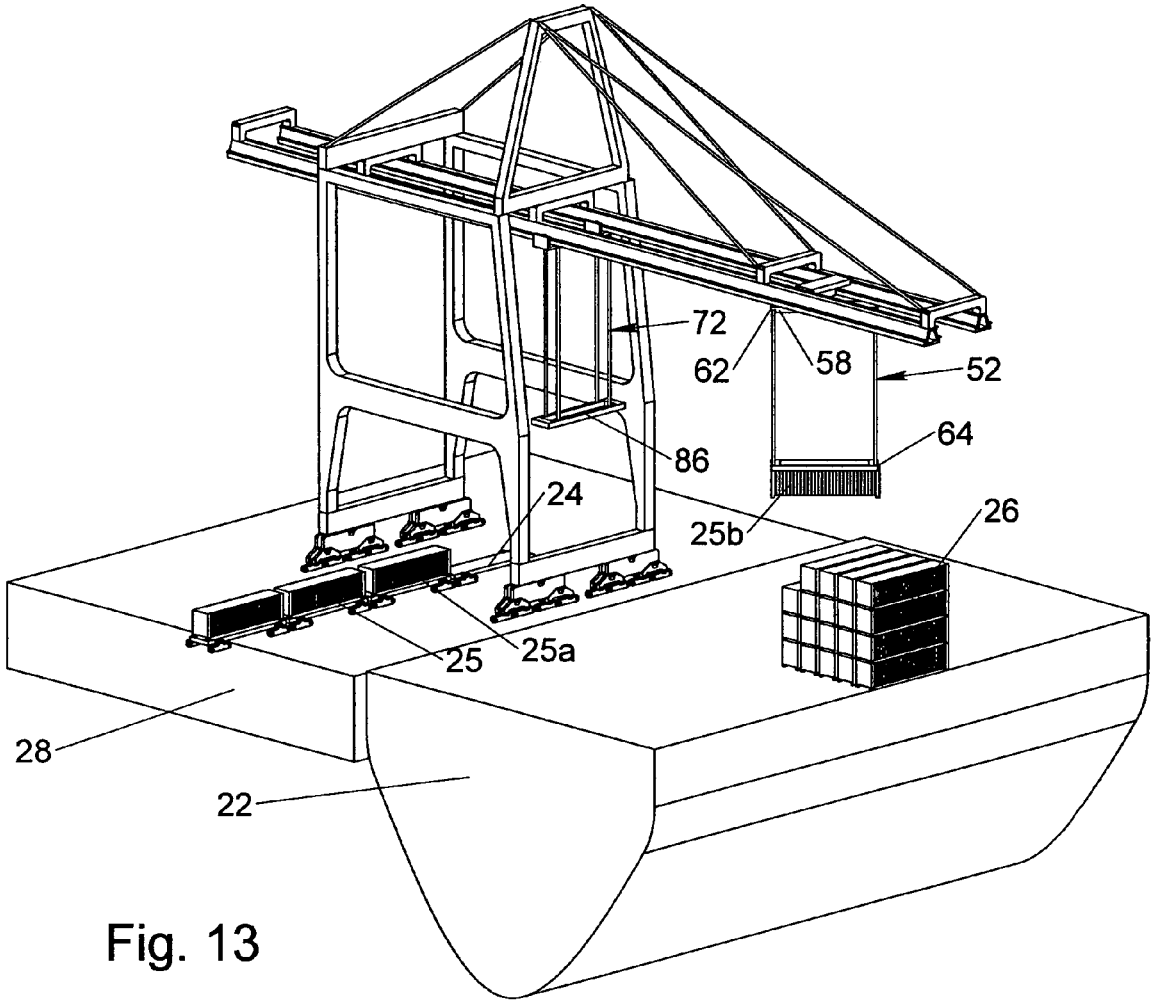
FIG. 13 is a generally isometric view, similar to FIG. 12, showing the empty lower trolley continuing its movement toward the barge and also showing the loaded upper trolley continuing its movement toward the dock, but rotated approximately 60 degrees from its orientation at the time of loading.

As illustrated in FIG. 13, the trolley turntable 58 has now rotated the upper and lower spreaders 62 and 64 of trolley assembly 52 to an approximate 60 degree position. Meanwhile, as the empty trolley assembly 72 has continued to move toward the ship and toward the bypass zone, the lower spreader 86 thereof has been raised even further.

Figure 14:
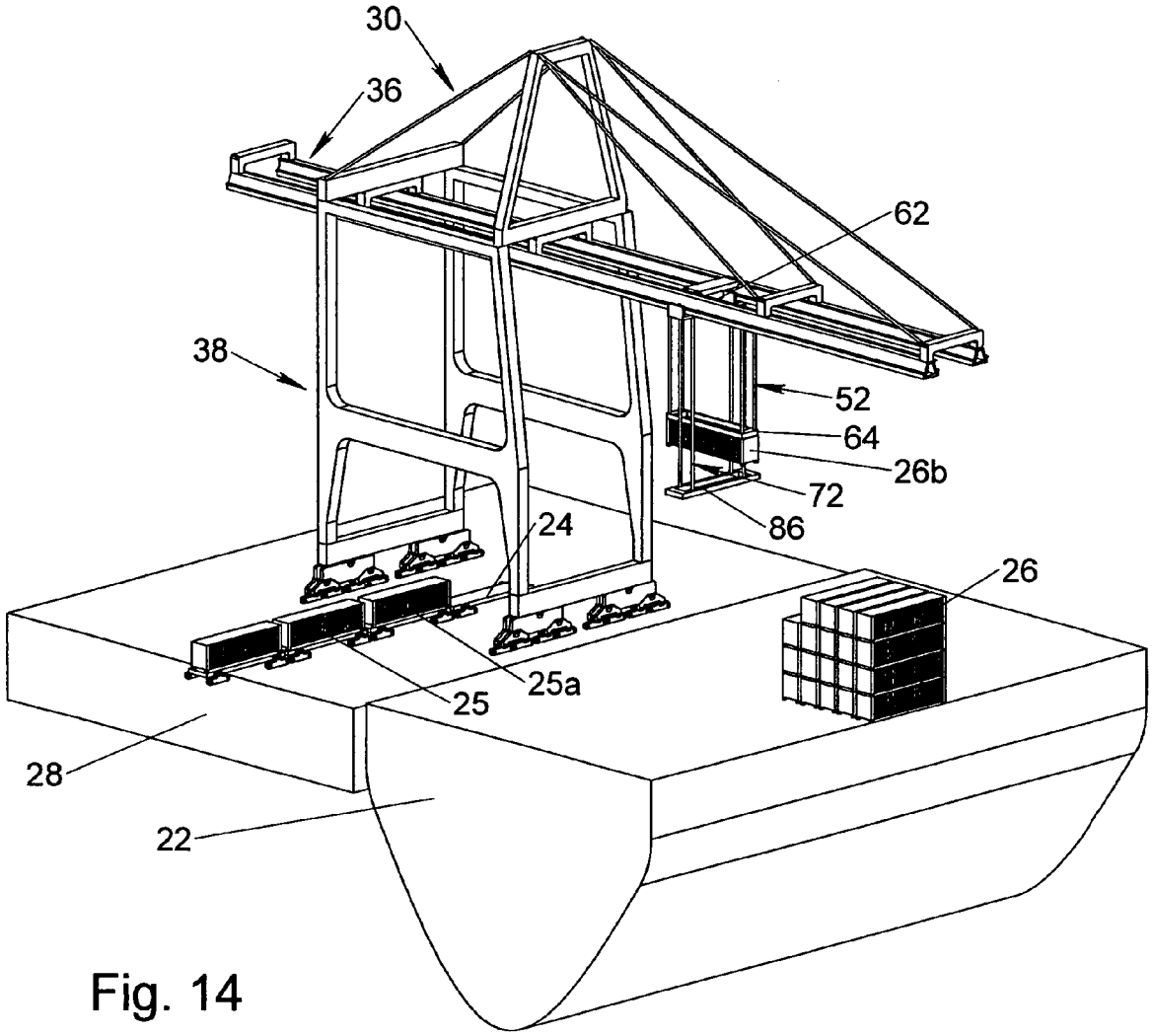
FIG. 14 is a generally isometric view, similar to FIG. 13, showing the loaded upper trolley and empty lower trolley having reached the bypass zone with the upper trolley having been rotated approximately 90 degrees from its loading orientation to permit the two trolleys to continue to move in opposite directions on the single boom of the system.

As depicted in FIG. 14, as the trolley assembly 52 has moved toward the bypass zone, the trolley turntable 58 has further rotated the upper and lower spreaders 62 and 64 thereof from their 60 degree position to an approximate 90 degree position wherein lower spreader 64 of trolley assembly 52 resides above the lower spreader 86 of trolley assembly 72 and between the cables of the cable system of the trolley assembly 72.

Figure 15:
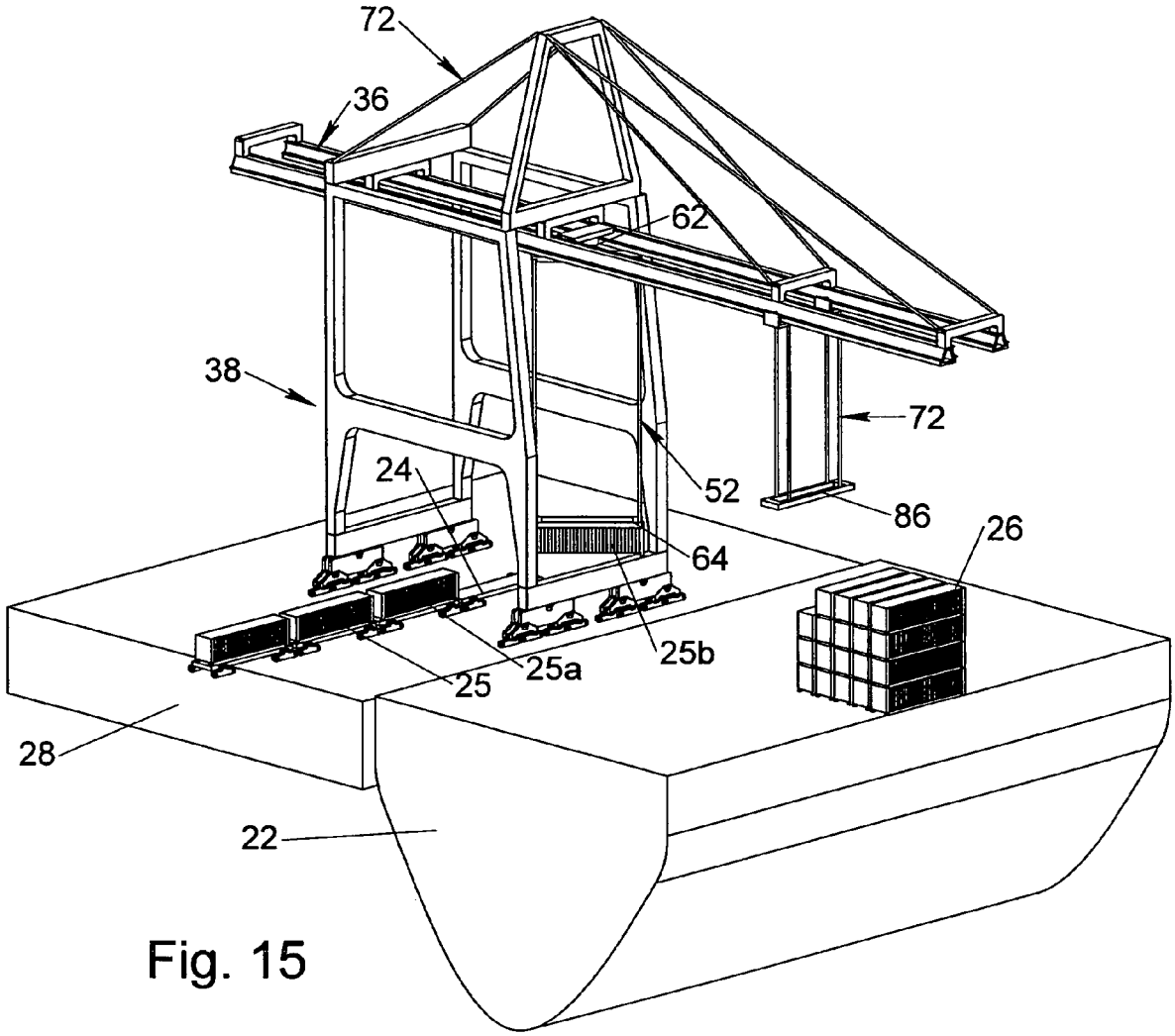
FIG. 15 is a generally isometric view, similar to FIG. 14, showing the empty lower trolley continuing its movement toward the barge and also showing the loaded upper trolley continuing its movement toward the dock, but rotated approximately 60 degrees from its orientation at the time of loading.

As best seen in FIG. 15 of the drawings, trolley assembly 72 has now exited the bypass zone and continues to move toward the ship. Similarly, loaded trolley assembly 52 has exited the bypass zone and continues to move toward the dock 28. As trolley assembly 52 moves toward the dock, the trolley turntable 58 rotates the upper and lower spreaders 62 and 64 from the approximate 90 degree position to an approximate 60 degree position.

Figure 16:
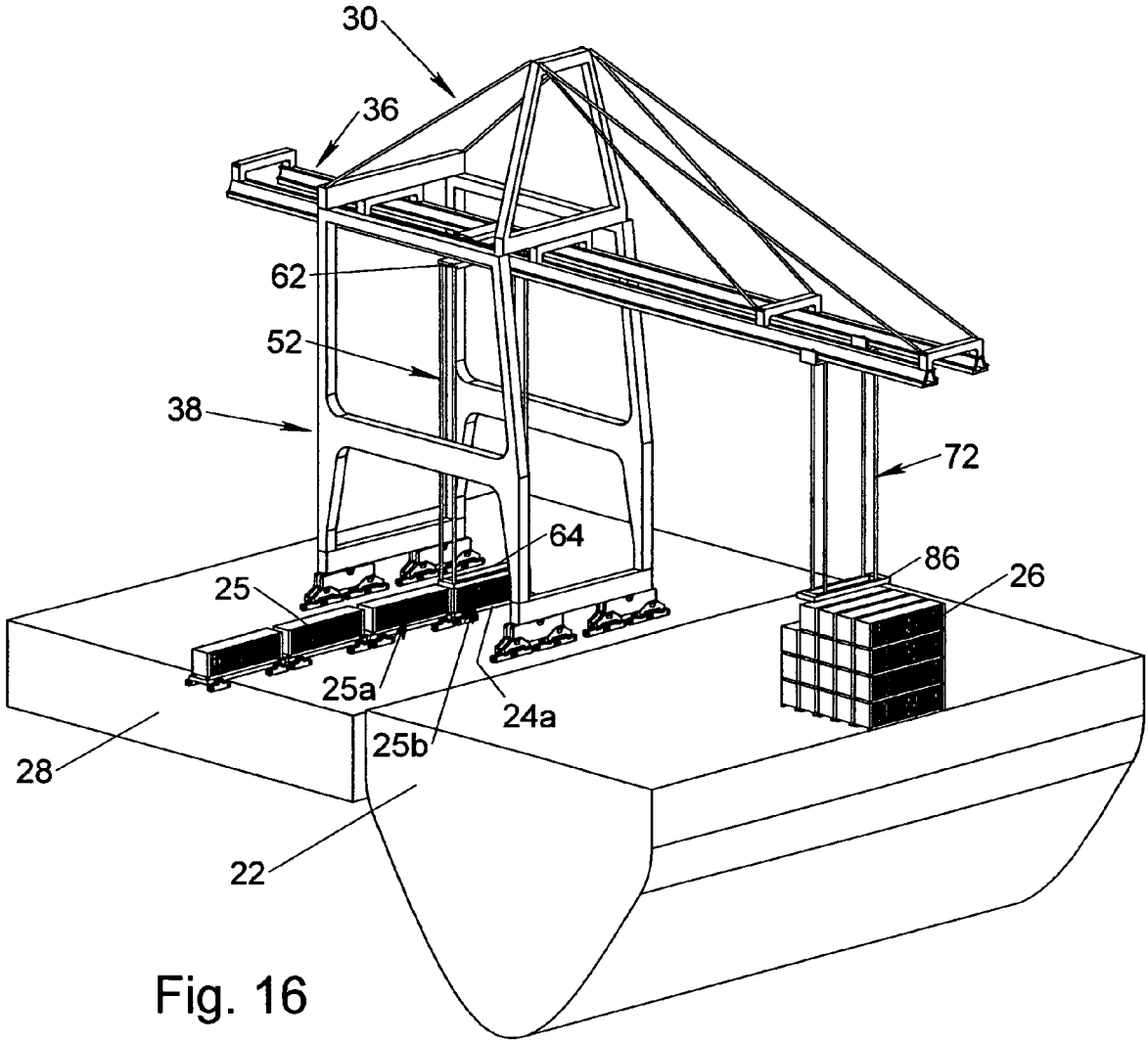
FIG. 16 is a generally isometric view, similar to FIG. 15, showing the loaded upper trolley in a container deposit position and showing the empty lower trolley in a container load position.

Turning finally to FIG. 16 of the drawings, it can be seen that the trolley system 52 has now moved into a position over the dock 28 and turntable 58 has rotated the upper and lower spreaders 62 and 64 from the approximate 60 degree position to an approximate 0 degree position. In this position, lower spreader 64 is positioned over a container flat car 24*a* so that shipping container 25*b* can be deposited on the flat car in a manner illustrated in FIG. 16. At the same time, as the empty trolley assembly 72 has moved to a position over the container stack 26 and the spreader 86 thereof has been appropriately lowered so that yet another container can be picked up from the container stack 26.

The container loading/unloading process as described in the preceding paragraphs can be continuously repeated thereby effectively doubling the rate of container loading and unloading possible with conventional prior art single boom crane systems.

Figure 17:
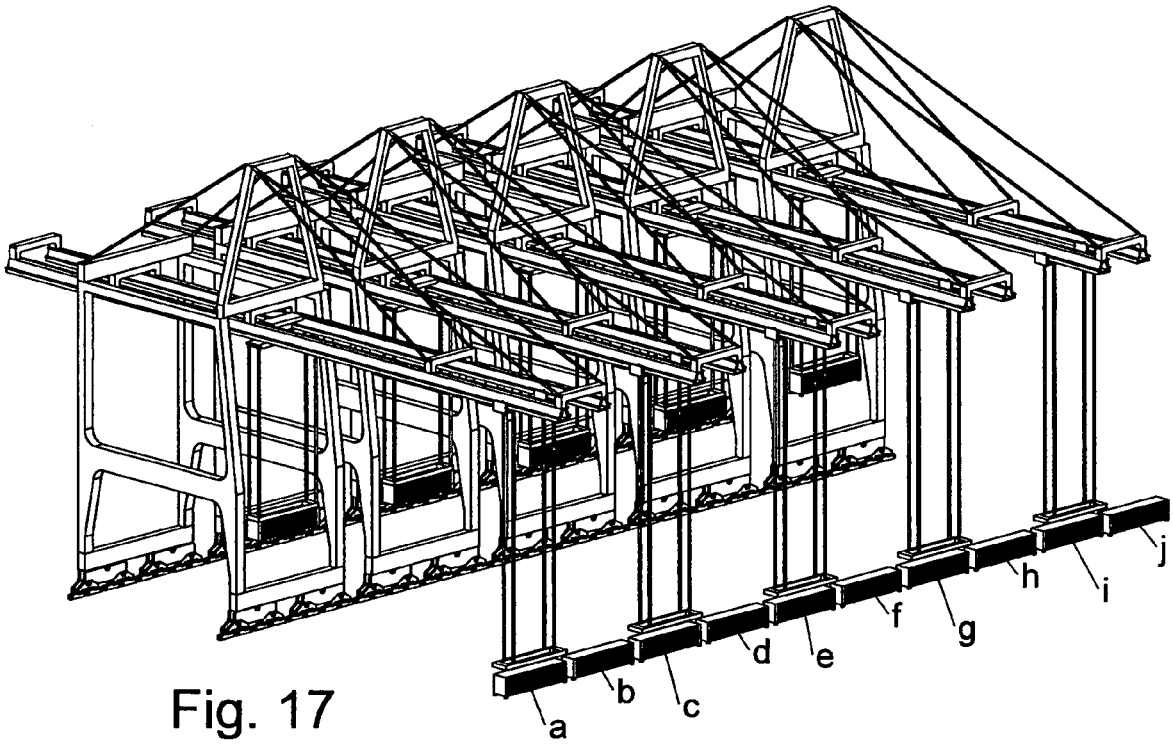
FIG. 17 is a generally isometric view showing a series of cranes positioned along the dock to simultaneously load and unload a container ship.
Figure 18:
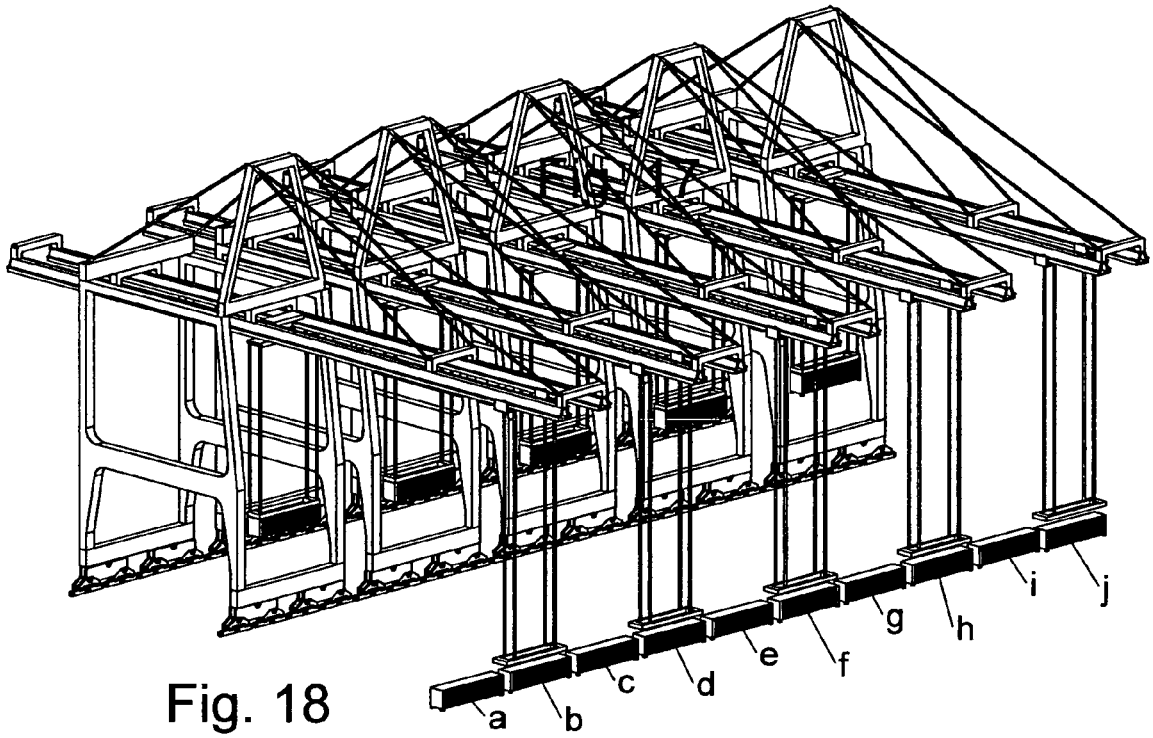
FIG. 18 is a generally isometric view, similar to FIG. 17, but illustrating the multiple crane system having been shifted to efficiently load and unload the container ship.

Turning next to FIGS. 17 and 18, these Figure drawings illustrate the common prior art practice of positioning more than one crane over the ship during container loading and unloading. FIG. 17 shows each of the cranes individually loading and unloading containers along the beam-to-beam container rows a, c, e, g, and i. FIG. 18 illustrates the appearance of the cranes after they have been moved along the dock to service beam-to-beam container rows b, d, f, h, and j. Positioning multiple cranes over the ship in the manner illustrated in FIGS. 17 and 18 increases the rate of loading/unloading. For this reason it is essential that the design width of the crane be held to a minimum so that more cranes, if available, may be position over the ship.

FIGS. 17 and 18 show a total of five cranes positioned over the ship. However, if these five cranes were to be retrofitted in accordance with the retrofit method of the present invention, they would have the loading and unloading capacity of ten single trolley, single boom cranes of the type currently in use.

Considering now the unique and important method of the present invention for retrofitting an existing crane system used for loading and unloading shipping containers from vessels moored at a dock. As illustrated in FIGS. 1 and 1A, the crane system to be modified typically comprises a crane frame 38 mounted on the dock; an elongated boom 36 supported by the crane frame and including a first end disposed over the dock and a second end disposed over the vessel. The elongated boom here comprises first and second spaced-apart boom elements 42 and 44, each being generally triangular in cross-section and each having an upper portion 42*a* and 44*a* and a lower portion 42*b* and 44*b* (see FIG. 1A). A pair of spaced-apart tracks 48*a* and 48*b* are carried by the spaced-apart boom elements of the elongated boom; and a trolley system 46 is carried by the pair of spaced-apart tracks for movement along the tracks from a first position over the dock and a second position over the vessel.

Figure 5:
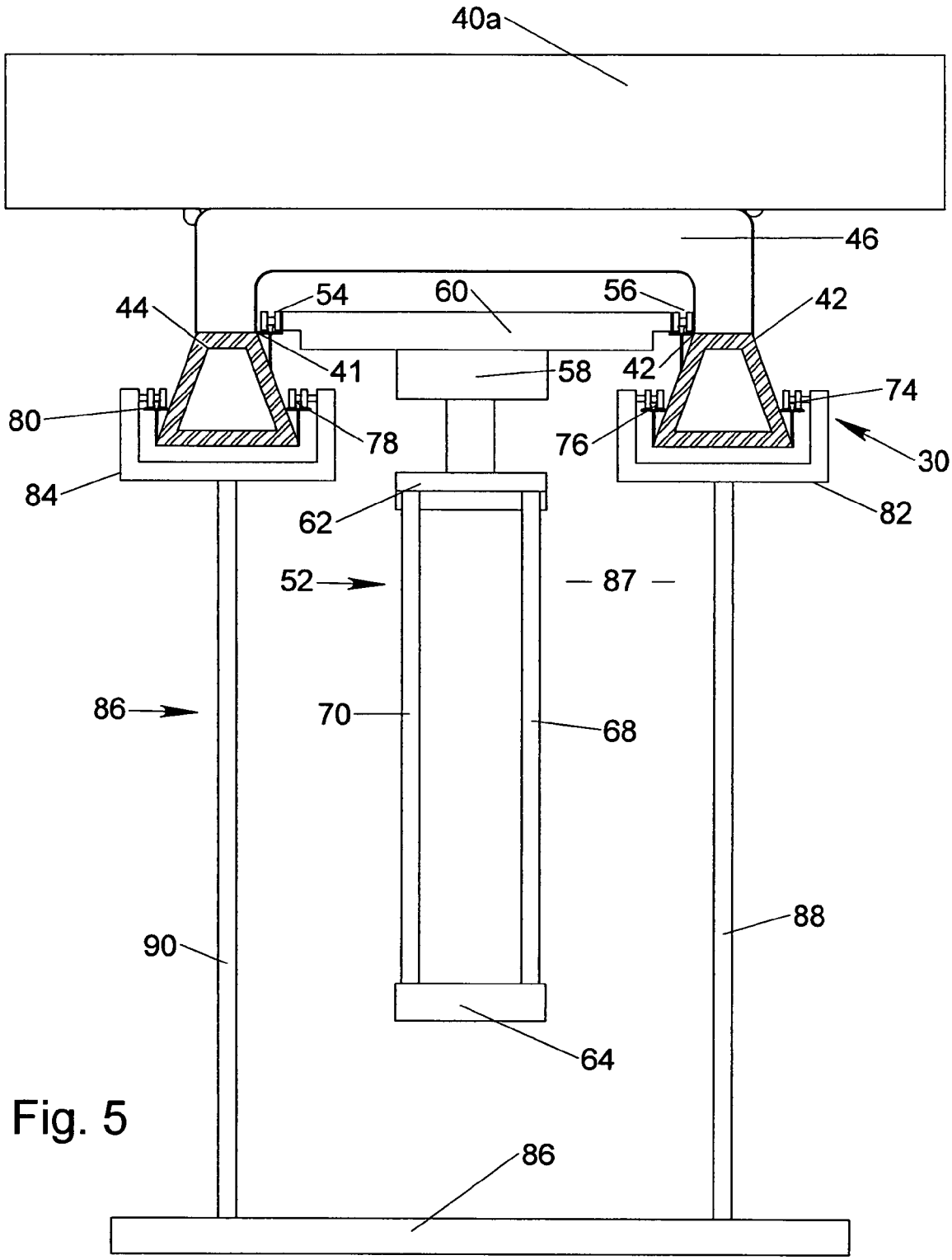
FIG. 5 is an enlarged front view of a portion of the dual trolley, single boom crane system illustrated in FIG. 2 showing the upper and lower trolleys in their passing configuration that permits the two trolleys to pass each other within the bypass zone as they individually move in opposite directions on the single boom of the system.

As best illustrated in FIGS. 3, 4 and 5 of the drawings, one form of the retrofit method of the invention comprises the steps of first removing the trolley system 46 and removing or modifying the pair of spaced-apart tracks 48*a* and 48*b* on the boom elements 42 and 44 (FIG. 1A). Spaced-apart tracks 48*a* and 48*b* of the prior art of FIG. 1A are later modified and connected into spaced-apart tracks 76 and 78 of FIG. 4. This done, a first pair of spaced-apart tracks 54 and 56 are installed unto the upper portions 42*a* and 44*a* of the first and second spaced-apart boom elements 42 and 44 (see FIG. 3). Next, a first trolley system 52 is constructed. As indicated in FIG. 3, this first trolley system here comprises upper and lower first spreaders 62 and 64 that are interconnected by a first pair of spaced-apart cables 68 and 70. The first trolley system further comprises a cable drive system 71 for raising and lowering the lower first spreader and a turntable 58 that is connected to the upper first spreader for rotating said upper and lower first spreaders through an angle of between about 0 and about 90 degrees. Following construction of the first trolley system 52, the system is installed in the manner shown in FIGS. 3 and 5 so that it is carried by the first pair of spaced-apart tracks 54 and 56 and is movable by a conventional trolley drive system well understood by those skilled in the art (not shown) along the tracks from a first position over the dock 28 and a second position over the vessel 22.

Also forming a part of the retrofit method of the present invention for retrofitting the prior art crane system is the step of installing a second pair of spaced-apart tracks 74 and 76 that are connected to the lower portion of boom element 42 and also installing a third pair of spaced-apart tracks 78 and 80 that are connected to the lower portion of boom element 44. This done, a second trolley system 72 is constructed. As indicated in FIG. 4, this second trolley system here comprises spaced-apart right and left carriages 82 an 84, a second lower spreader 86 for interconnection with a shipping container. A second pair of spaced-apart cables 88 and 90 interconnect the carriages with the lower spreader and function to raise and lower the spreader. Following construction of the second trolley system 72, the system is installed in the manner shown in FIGS. 4 and 5 so that it is carried by a second pair of spaced-apart tracks 74 and 76 that are connected to the lower portion of boom element 42 and also by a third pair of spaced-apart tracks 78 and 80 that are connected to the lower portion of boom element 44. Second trolley system 72 is movable by a conventional trolley drive system 91 (not shown) along the tracks from a first position over the dock 28 and a second position over the vessel 22.

As previously discussed, the modification of current single trolley, single boom to dual trolley, single boom cranes in accordance with the retrofit method of the invention just described can be accomplished while the crane system remains in service with minimum down-time.

The crane system as modified in accordance with the retrofit method of the invention discussed in the preceding paragraphs can be operated in substantially the same manner as the previously described dual trolley, single boom crane system of the present invention to load and unload shipping containers from vessels moored at a dock.

As previously discussed, the crane system as modified in accordance with the retrofit method of the invention effectively doubles the loading/unloading rate of a typical prior art crane system while at the same time retaining the basic geometry of the prior art system so that the same number of multiple cranes may be positioned over the ship or barge.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A crane system for loading and unloading shipping containers from vessels moored at a dock said system comprising:

(a) a crane frame mounted on the dock;

(b) an elongated boom supported by said crane frame and including a first end disposed over the dock and a second end disposed over the vessel, said elongated boom comprising first and second spaced-apart boom elements, each having an upper portion and a lower portion;

(c) a first pair of spaced-apart tracks carried by said upper portion of said first and second spaced-apart boom elements of said elongated boom;

(d) a second pair of spaced-apart tracks carried by said lower portion of said first boom element of said first and second spaced- apart boom elements of said elongated boom;

(e) a third pair of spaced-apart tracks carried by said lower portion of said second boom element of said first and second spaced-apart boom elements of said elongated boom;

(f) a first trolley system carried by said first pair of spaced-apart tracks and movable along said tracks from a first position over the dock and a second position over the vessel, said first trolley system comprising upper and lower first spreaders interconnected by a first pair of spaced-apart cables for raising and lowering said lower first spreader and a turntable connected to said upper first spreader for rotating said upper and lower first spreaders through an angle of between 0 and 90 degrees;

g) a second trolley system carried by said second and third pair of spaced-apart tracks and movable along said tracks from a first position over the dock and a second position over the vessel, said second trolley system comprising first and second carriages, a lower second spreader and pair of spaced-apart cables interconnecting said first and second carriages for raising and lowering said lower second spreader, said upper and lower first spreaders being movable between said first pair of spaced-apart cables of said first trolley system when said upper and lower first spreaders have been rotated through an angle of 90 degrees.

2. The crane system as defined in claim 1 in which said first and second spaced-apart boom elements are generally triangular in cross-section.

3. The crane system as defined in claim 1 in which first trolley system further comprises a transversely extending bridge member and in which said turntable of said first trolley system is connected to said transversely extending bridge member.

* * * * *